US009926926B2

(12) United States Patent
Kuroyanagi et al.

(10) Patent No.: US 9,926,926 B2
(45) **Date of Patent: *Mar. 27, 2018**

(54) HIGH-PRESSURE PUMP

(71) Applicant: DENSO CORPORATION, Kariya, Aichi-pref. (JP)

(72) Inventors: Masatoshi Kuroyanagi, Kariya (JP); Mamoru Urushizaki, Chiryu (JP); Yasuaki Matsunaga, Anjo (JP); Shinobu Oikawa, Kariya (JP); Noriya Matsumoto, Okazaki (JP)

(73) Assignee: DENSO CORPORATION, Kariya (JP)

( * ) Notice: Subject to any disclaimer, the term of this patent is extended or adjusted under 35 U.S.C. 154(b) by 3 days.

This patent is subject to a terminal disclaimer.

(21) Appl. No.: 14/989,122

(22) Filed: Jan. 6, 2016

(65) Prior Publication Data

US 2016/0115953 A1 Apr. 28, 2016

Related U.S. Application Data

(63) Continuation of application No. 13/433,641, filed on Mar. 29, 2012, now Pat. No. 9,261,061.

(30) Foreign Application Priority Data

Mar. 31, 2011 (JP) ..... 2011-078356
Aug. 29, 2011 (JP) ..... 2011-185884

(51) Int. Cl.
*F04B 53/16* (2006.01)
*F02M 59/36* (2006.01)
(Continued)

(52) U.S. Cl.
CPC ..... *F04B 53/16* (2013.01); *F02M 59/025* (2013.01); *F02M 59/368* (2013.01);
(Continued)

(58) Field of Classification Search
CPC .. F02M 59/462; F02M 2200/03; F02M 59/44; F02M 55/04; F02M 59/466;
(Continued)

(56) References Cited

U.S. PATENT DOCUMENTS 3,510,233 A * 5/1970 Habegger ..... F04B 39/12 417/454
6,530,759 B2 * 3/2003 Sano ..... F02M 59/442 277/436

(Continued)

FOREIGN PATENT DOCUMENTS

| | | |
|---|---|---|
| EP | 2 055 934 | 5/2009 |
| JP | 2008-525713 | 7/2008 |
| JP | 4478431 | 3/2010 |

OTHER PUBLICATIONS

Office Action (6 pages) dated Jan. 6, 2014, issued in corresponding Chinese Application No. 201210090925.0 and English translation (5 pages).

*Primary Examiner* — Devon Kramer
*Assistant Examiner* — Lilya Pekarskaya
(74) *Attorney, Agent, or Firm* — Nixon & Vanderhye P.C.

(57) ABSTRACT

A high-pressure pump is comprised of a lower housing, an upper housing and a cover, which are formed independently from each other. Thereby, shapes of the above can be simplified. Although the cylinder and the plunger receive a fuel pressure during a pressurization stroke, the upper housing and the cover do not receive fuel pressure directly from a pressurization chamber. Therefore, the upper housing and the cover can be made thin and light as much as possible.

5 Claims, 20 Drawing Sheets

(51) Int. Cl.

| | |
|---|---|
| ***F02M 59/44*** | (2006.01) |
| ***F02M 59/46*** | (2006.01) |
| ***F04B 9/12*** | (2006.01) |
| ***F04B 53/10*** | (2006.01) |
| ***F02M 59/02*** | (2006.01) |
| ***F04B 7/02*** | (2006.01) |

(52) U.S. Cl.
CPC ..... *F02M 59/44* (2013.01); *F02M 59/462* (2013.01); *F02M 59/466* (2013.01); *F04B 7/0266* (2013.01); *F04B 9/12* (2013.01); *F04B 53/10* (2013.01); *F02M 2200/03* (2013.01); *F02M 2200/8084* (2013.01); *Y10T 137/85978* (2015.04)

(58) Field of Classification Search
CPC . F02M 59/368; F04B 11/0016; F04B 39/055; F04B 11/033; F04B 53/10; F04B 9/12; F04C 15/0049
USPC ..... 417/540, 505; 137/565.01; 123/495, 446
See application file for complete search history.

(56) References Cited

U.S. PATENT DOCUMENTS

| | | | |
|---|---|---|---|
| 6,631,706 | B1 | 10/2003 | Yamada et al. |
| 2008/0289713 | A1 | 11/2008 | Munakata et al. |
| 2009/0110575 | A1 | 4/2009 | Munakata et al. |
| 2009/0291006 | A1 | 11/2009 | Inoue et al. |
| 2011/0110809 | A1 | 5/2011 | Inoue |

* cited by examiner

HIGH-PRESSURE PUMP

CROSS-REFERENCE TO RELATED APPLICATION

This application is a continuation application of U.S. patent application Ser. No. 13/433,641, filed Mar. 29, 2012, now allowed, which is based on Japanese Patent Applications No. 2011-78356 filed on Mar. 31, 2011 and No. 2011-185884 filed on Aug. 29, 2011, the disclosures of each of which are incorporated herein by reference.

TECHNICAL FIELD

The present invention relates to a high-pressure pump which pressurizes and discharges a fuel.

BACKGROUND

A high-pressure pump has a plunger which reciprocates to pressurize fuel in a pressurizing chamber. JP-2008-525713A shows a high-pressure pump which has a suction passage, a pressurization chamber and a discharge passage in a housing. A cylinder supporting the plunger is provided to the housing. A suction valve and a discharge valve are provided to the housing.

WO-00-47888 (U.S. Pat. No. 6,631,706B1) shows a high-pressure pump in which a housing an opening opposite to a pressurization chamber relative to a plunger. A cylinder is fixed in the opening of the housing. The pressurization chamber is defined between the plunger and a screw member which closes the opening of the housing.

Japanese Patent No. 4478431 shows a high-pressure pump in which a housing has an opening communicating with a pressurization chamber. A cylinder is inserted into the opening of the housing.

In order to discharge a high-pressure fuel, the housing should have an enough thickness, which makes a shape of the housing complicated and increases the weight of the housing.

SUMMARY

It is an object of the present disclosure to provide a high-pressure pump which has a simply configured housing so as to reduce its weight.

A high-pressure pump is provided with a plunger, a cylinder, a lower housing, an upper housing, a suction valve, a discharge valve and a cover. The plunger is supported by the cylinder in such a manner as to reciprocate in its axial direction. The cylinder receiving the plunger defines a pressurization chamber therein. The lower housing supports the cylinder. The upper housing is made independently from the lower housing and is connected to an outer wall of the cylinder. The upper housing has a suction passage through which a fuel is suctioned into the pressurization chamber. Further, the upper housing has a discharge passage through which the fuel pressurized in the pressurization chamber is discharged.

The suction valve includes: a suction valve member which closes and opens the suction passage; and a suction valve body forming a valve seat against which the suction valve member abuts. The discharge valve includes a discharge valve member and a discharge valve body against which the discharge valve member abuts. The cover is cup-shaped and is made independently from the lower and the upper housing. The upper housing is accommodated in the cover. The cover has a first through-hole through which the suction valve body is inserted and a second through-hole through which the discharge valve body is inserted.

A housing of the high-pressure pump is comprised of the lower housing, the upper housing and the cover, which are formed independently. Thereby, the shapes of the above can be simplified. The configuration of the housing of the high-pressure pump can be simplified and its weight can be reduced. Although the cylinder and the plunger receive the fuel pressure during the pressurization stroke, the upper housing and the cover do not receive fuel pressure directly from the pressurization chamber. Therefore, the upper housing and the cover can be made thin. The cover can be easily shaped into a cup-shape.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
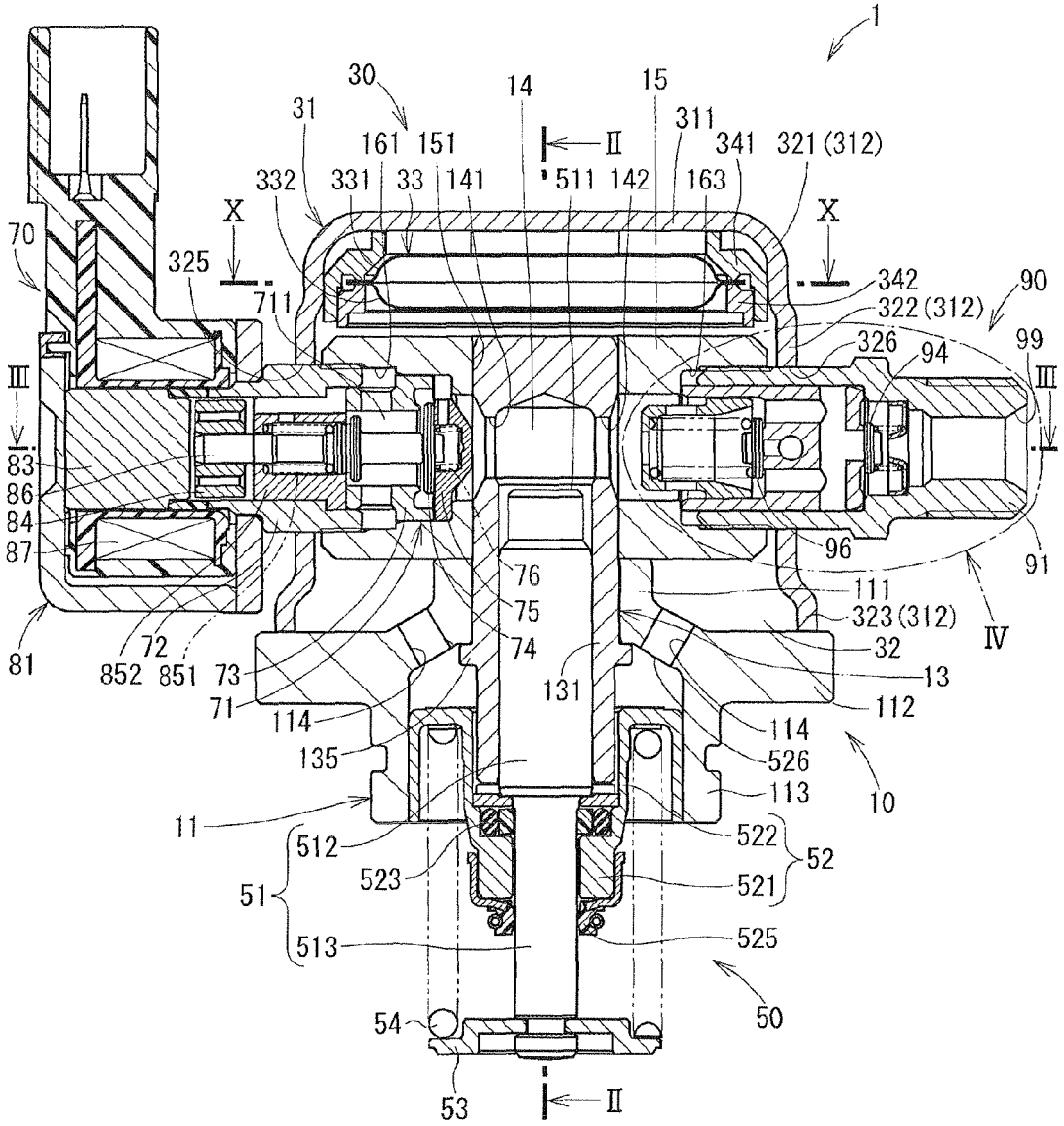
FIG. 1 is a cross-sectional view showing a high-pressure pump according to a first embodiment.
Figure 2:
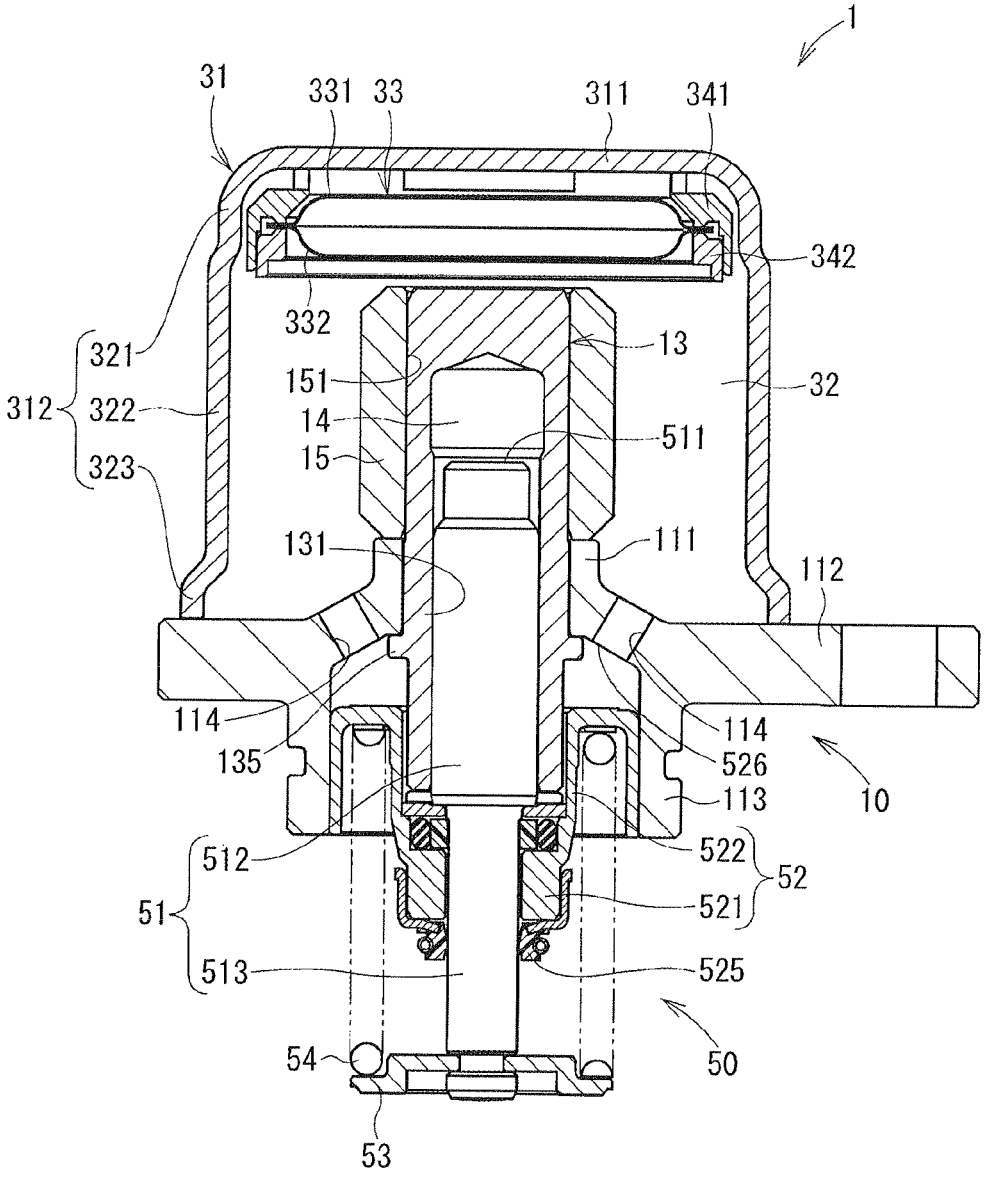
FIG. 2 is a cross-sectional view taken along a line II-II in FIG. 1.

Multiple embodiments of the present invention will be described with reference to accompanying drawings.

First Embodiment

FIGS. 1 to 10 illustrate a high-pressure pump 1 according to a first embodiment of the invention. The high-pressure pump 1 pressurizes a fuel, which is pumped up from a fuel tank, and discharges the pressurized fuel to a fuel-rail to which a fuel injector is connected. The high-pressure pump 1 includes a body portion 10, a fuel supply portion 30, a plunger portion 50, a fuel suction portion 70, and a fuel-discharge-relief portion 90. In the following description, the upper side of FIG. 1 will be taken as "up", "upward" or "upper," and the low side of the FIG. 1 will be taken as "down", "downward" or "lower."

The body portion 10 includes a lower housing 11, a cylinder 13 and an upper housing 15. The lower housing 11 includes: a cylindrical cylinder-holding-portion 111; an annular flange portion 112 protruded from the lower part of the cylinder-holding-portion 111; and a cylindrical engaging portion 113 which is engaged with an engine (not shown). The flange portion 112 has a plurality of fuel paths 114 through which fuel flows.

The cylinder-holding-portion 111 and the cylindrical engaging portion 113 are grinded in order to be engaged with the engine. The lower housing 11 is made from stainless steel.

The cylinder 13 has an opening end at its lower end and is inserted into the cylinder-holding-portion 111. The cylinder 13 has an annular protrusion 135 which is in contact with the cylinder-holding-portion 111, whereby an axial position of the cylinder 13 relative to the cylinder-holding-portion 111 is fixed. The cylinder 13 has an inner wall surface 131 on which the plunger 51 slides. The inner wall surface 131 defines a pressurization chamber 14 in cooperation with a top surface of the plunger 51. When the plunger 51 slides up in the cylinder 13, the fuel in the pressurization chamber 14 is pressurized.

The cylinder 13 has a first communication passage 141 and a second communication passage 142 which extend in opposite directions. These passages 141, 142 are symmetrically arranged with respect to an axis of the plunger 51. The hardness of the cylinder 13 is enhanced by heat treatment, such as quenching, in order to suppress seizure and wear due to sliding of the plunger 51.

Figure 3:
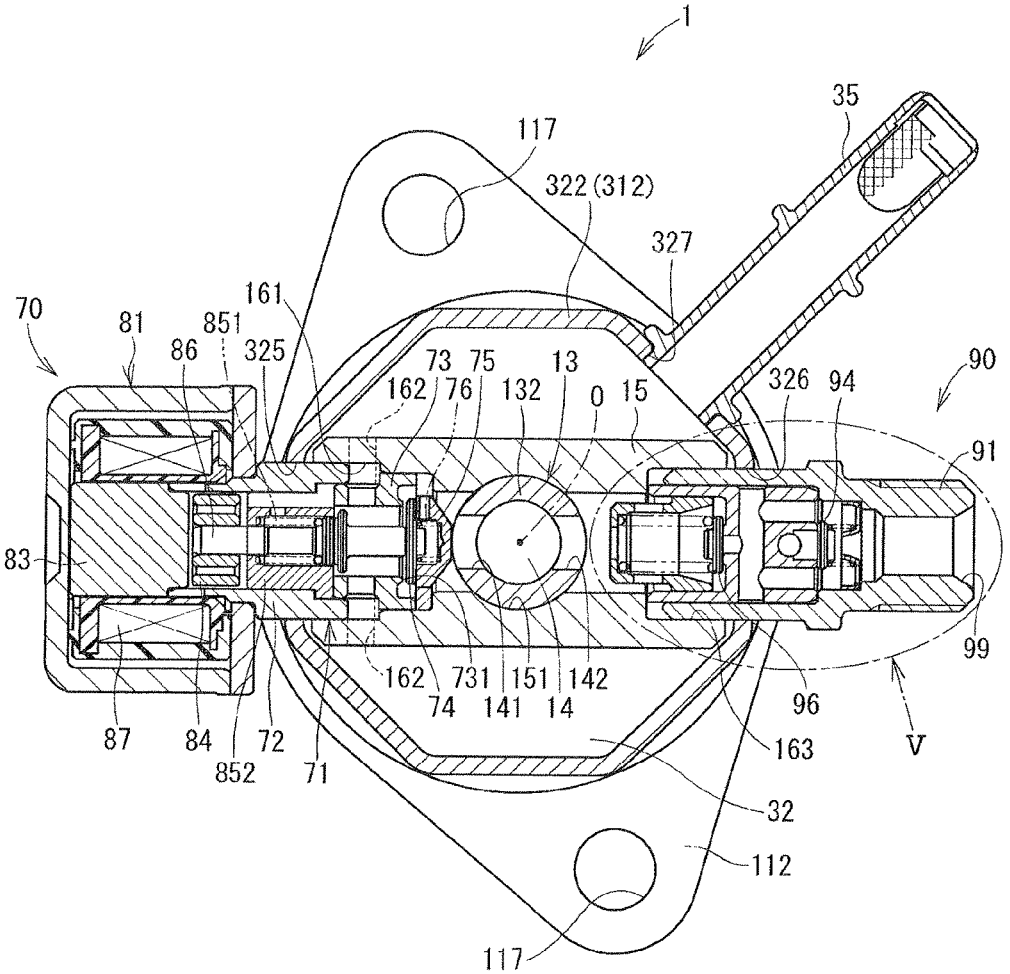
FIG. 3 is a cross-sectional view taken along a line in FIG. 1.

As illustrated in FIG. 3, the upper housing 15 is substantially in a shape of a rectangular parallelepiped extending in a direction substantially orthogonal to an axis of the cylinder 13. The upper housing 15 is formed independently from the lower housing 11. The upper housing 15 has a press-insert hole 151 through which the cylinder 13 is press-inserted so that no fuel leaks therethrough. Although the upper housing 15 and the lower housing 11 are in contact with each other in the present embodiment, it is not always required for them to be in contact with each other.

The upper housing 15 includes a stepped first suction passage 161 and multiple second suction passages 162. The first suction passage 161 penetrates the upper housing 15 in a direction opposite to the pressurization chamber 14 in such a manner as to communicate with the first communication passage 141. The second suction passages 162 orthogonally extend from the first suction passage 161. These first and second suction passages 161, 162 define a suction passage along with the first communication passage 141. The fuel is suctioned into the pressurization chamber 14 through this suction passage.

The upper housing 15 includes a stepped first discharge passage 163 which extends in a direction opposite to the pressurization chamber 14 with respect to the second communication passage 142. The first discharge passage 163 communicates with the second communication passage 142. The first discharge passage 163 and the second communication passage 142 define a discharge passage. The pressurized fuel is discharged through this discharge passage.

The above press-insert hole 151, the first suction passage 161, the second suction passages 162 and the first discharge passage 163 are formed by machining the upper housing 15. As long as these hole and passages can be formed in the upper housing 15, the upper housing 15 can be made thin to reduce its weight.

The fuel supply portion 30 will be described hereinafter.

Figure 7:
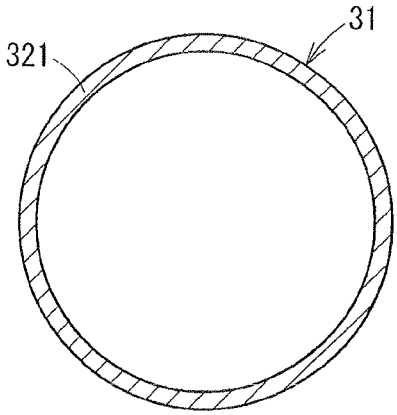
FIG. 7 is a cross-sectional view taken along a line VII-VII in FIG. 6.
Figure 8:
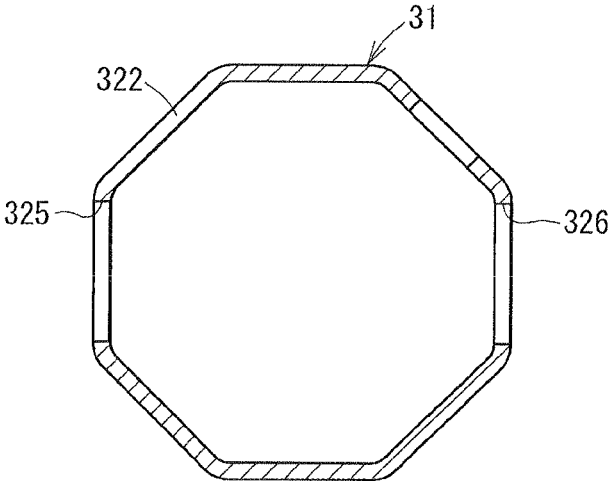
FIG. 8 is a cross-sectional view taken along a line VIII-VIII in FIG. 6.
Figure 9:
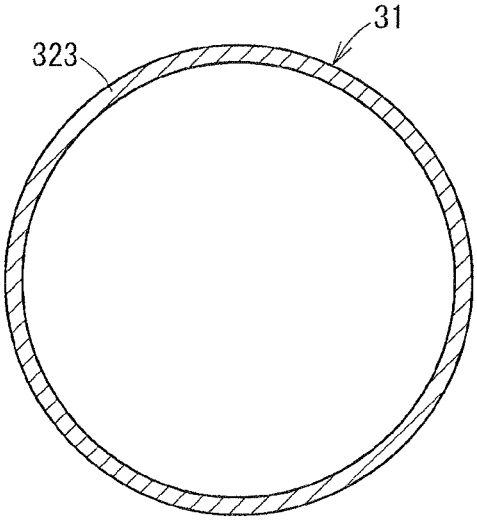
FIG. 9 is a cross sectional view taken along a line IX-IX in FIG. 6.

The fuel supply portion 30 includes a cover 31, a pulsation damper 33, and a fuel inlet 35. The cover 31 accommodates a top portion of the cylinder 13 and the upper housing 15. The cover 31 is comprised of a flat portion 311 and a cylindrical portion 312. The flat portion 311 closes an upper portion of the cylindrical portion 312. The cylindrical portion 312 is comprised of a first cylindrical portion 321, an octagonal portion 322 and a second cylindrical portion 323 as shown in FIGS. 7 to 9.

An inner diameter of the first cylindrical portion 321 is smaller than that of the second cylindrical portion 323. The octagonal portion 322 has an octagonal cross section. This octagonal cross section is not always mathematically octagonal. An angle portion can be rounded.

The octagonal portion 322 has four pairs of flat walls. The first cylindrical portion 321 and the second cylindrical portion 323 are connected to the octagonal portion 322 through curved walls, which enhances a rigidity of the cover 31.

Figure 6:
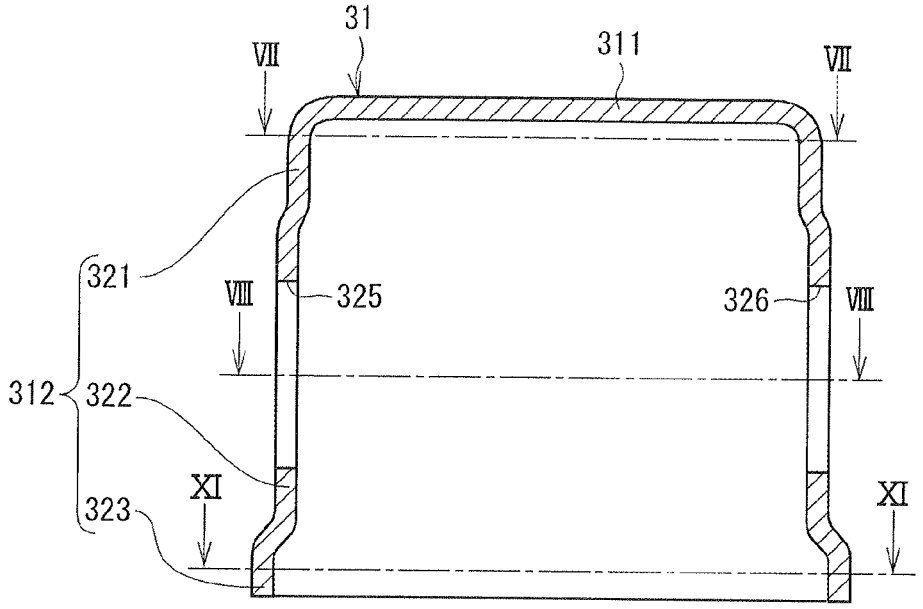
FIG. 6 is a cross-sectional view showing a cover according to the first embodiment.

As shown in FIG. 6, the octagonal portion 322 has a first through-hole 325 and a second through-hole 326 which confront each other. A suction valve body 72 is inserted into the first through-hole 325. A discharge relief housing 91 is inserted into the second through-hole 326.

Further, the octagonal portion 322 has a third through-hole 327 circumferentially adjacent to the second through-hole 326. A based portion of the fuel inlet 35 is inserted into the third through-hole 327. The cover 31 is made of stainless steel. As long as a fuel gallery 32 can be defined inside of the cover 31, the cover 31 can be made thin to reduce its weight.

The cover 31, the flange portion 112, the suction valve body 72, the discharge relief housing 91 and the fuel inlet 35 are respectively connected by welding. The cover 31 defines the fuel gallery 32 therein. The fuel gallery 32 communicates with the second suction passage 162. The fuel flows into the fuel gallery 32 from the fuel inlet 35 and flows into the pressurization chamber 14 through the second suction passage 162 and the like.

Figure 10:
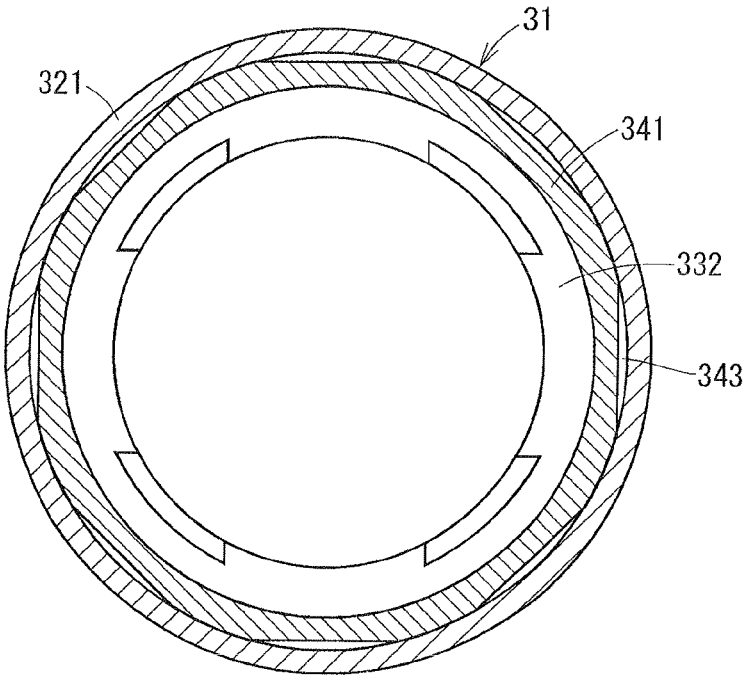
FIG. 10 is a cross-sectional view taken along a line X-X in FIG. 1.

A pulsation damper 33 is arranged in the fuel gallery 32. The pulsation damper 33 is configured by joining together the peripheral edge portions of two diaphragms 331, 332. The pulsation damper 33 is sandwiched between an upper support member 341 and a lower support member 342 so as to be fixed on an inner wall of the first cylindrical portion 321. As shown in FIG. 10, a plurality of fuel passages 343 are formed between an inner wall of the first cylindrical portion 321 and the upper support member 341. The fuel flows into an upper space of the pulsation damper 33 through the fuel passages 343.

A gas of predetermined pressure is sealed inside of the pulsation damper 33. The pulsation damper 33 is elastically deformed according to change in the fuel pressure in the fuel gallery 32, whereby a fuel pressure pulsation in the fuel gallery 32 is reduced. The cover 31 functions as a housing member for the pulsation damper 33.

The plunger portion 50 will be described hereinafter. The plunger portion 50 includes a plunger 51, an oil seal holder 52, a spring seat 53, a plunger spring 54, and the like. The plunger 51 has a large-diameter portion 512 and a small-diameter portion 513. The large-diameter portion 512 slides on an inner wall 131 of the cylinder 13. The small-diameter portion 513 is inserted into an oil seal holder 52.

The oil seal holder 52 is placed at an end of the cylinder 13. The oil seal holder 52 includes a base portion 521 and a press-fit portion 522 press-inserted into an inner wall of the engaging portion 113. The base portion 521 has a ring-shaped seal 523 therein. The seal 523 is comprised of a ring located inside in the radial direction and an O-ring made of rubber located outside. The thickness of a fuel oil film around the small-diameter portion 513 of the plunger 51 is adjusted by the seal 523 and the leakage of fuel to the engine is suppressed. The base portion 521 has an oil seal 525 at a tip end thereof. The thickness of an oil film around the small-diameter portion 513 of the plunger 51 is controlled by the oil seal 525 and oil leakage is suppressed.

The press-fit portion 522 is a portion cylindrically extending around the base portion 521. The extending cylindrical portion has "U-shaped". A recessed portion 526 corresponding to the press-fit portion 522 is formed in the lower housing 11. The press-fit portion 522 is press-inserted to the inner wall of the recessed portion 526. The spring seat 53 is provided at a lower end of the plunger 51. The lower end of the plunger 51 is in contact with a tappet (not shown). The tappet has its outer surface abutted against a cam installed on a cam shaft and is reciprocatively moved in the axial direction according to the cam profile by the rotation of the cam shaft.

One end of the plunger spring 54 is engaged with the spring seat 53 and the other end of the plunger spring 54 is engaged with the press-fit portion 522. As a result, the plunger spring 54 functions as a return spring for the plunger 51. The plunger spring 54 biases the plunger 51 so as to abut against the tappet. With this configuration, the plunger 51 is reciprocatively moved according to the rotation of the cam shaft. As this time, the volumetric capacity of the pressurization chamber 14 is varied by the movement of the large-diameter portion 512 of the plunger 51.

The fuel suction portion 70 will be described hereinafter. The fuel suction portion 70 includes a suction valve portion 71 and an electromagnetic driving unit 81. The suction valve portion 71 includes the suction valve body 72, a seat body 73, a suction valve member 74, a first spring holder 75, a first spring 76, and the like. The suction valve body 72 is threaded into the first suction passage 161. The suction valve body 72 defines a suction chamber 711 therein. The suction chamber 711 communicates with the fuel gallery 32 through the second suction passage 162. The cylindrical seat body 73 is arranged in the suction chamber 711. A valve seat 731 (refer to FIG. 3) that can be abutted against the suction valve member 74 is formed on the seat body 73.

The suction valve member 74 is arranged in such a manner as to abut against the valve seat 731. When unseated from the valve seat 731, the suction valve member 74 fluidly connects the suction chamber 711 and the pressurization chamber 14. When seated on the valve seat 731, the suction valve member 74 fluidly disconnects the suction chamber 711 and the pressurization chamber 14. A first spring holder 75 accommodates a first spring which biases the suction valve member 74 in a left direction in FIG. 1.

An electromagnetic actuator 81 is comprised of a fixed core 83, a movable core 84 and a needle 86. The movable core 84 is connected to one end of the needle 86. The needle 86 is supported by a second spring holder 852 and is capable of abutting against the suction valve member 74. A second spring 851 is provided inside of the second spring holder 852 in such a manner as to bias the needle 86 toward the suction valve member 74. The second spring 851 biases the needle 86 in the valve opening direction with a force larger than a force with which the first spring 76 biases the suction valve member 74 in the valve closing direction.

The fixed core 83 is arranged opposite to the suction valve member 74 with respect to the movable core 84. A coil 87 is wound around the fixed core 83. When the coil 87 is energized, the fixed core 83 generates magnetic force. The fixed core 83 attracts the movable core 84 against a biasing force of the second spring 851. The needle 86 moves along with the movable core 84. As a result, the suction valve portion 71 is closed. When the coil 87 is deenergized, the needle 86 move away from the fixed core 83 by the biasing force of the second spring 88. As a result, the suction valve portion 71 is opened.

Figure 4:
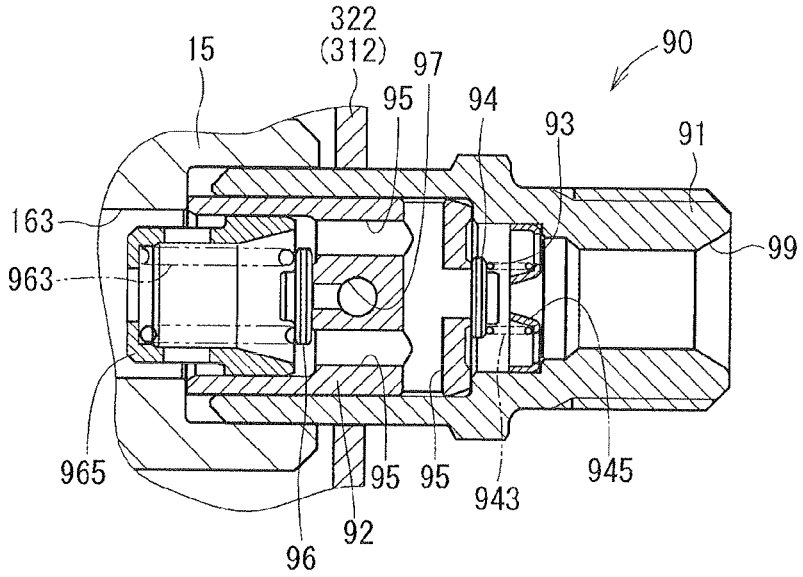
FIG. 4 is a cross-sectional view showing a fuel-discharge-relief portion denoted by an arrow IV in FIG. 1.
Figure 5:
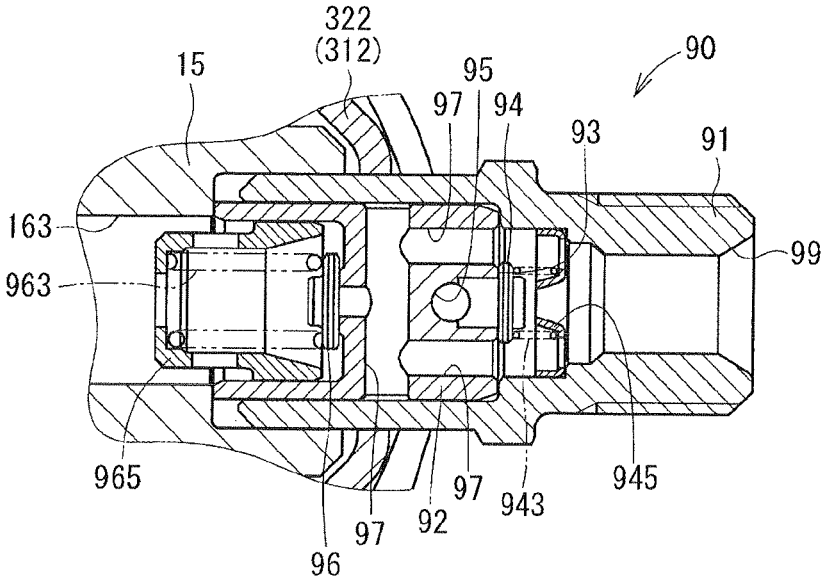
FIG. 5 is a cross-sectional view showing a fuel-discharge-relief portion denoted by an arrow V in FIG. 3.

With reference to FIGS. 4 and 5, the fuel-discharge-relief portion 90 will be described hereinafter. The fuel-discharge-relief portion 90 includes a fuel-discharge-relief housing 91, a valve body 92, a discharge valve member 94 and a relief valve member 96. The fuel-discharge-relief housing 91 is cylindrically shaped and is threaded into the first discharge passage 163. The fuel-discharge-relief housing 91 accommodates the valve body 92, the discharge valve member 94 and the relief valve member 96.

The valve body 92 is cup-shaped and has an opening toward the pressurization chamber 14. The valve body 92 has a discharge passage 95 and a relief passage 97. These passages 95, 97 do not communicate with each other. The discharge passage 95 extends radially outwardly and extends axially. Also, the relief passage 97 extends radially outwardly and extends axially.

In the fuel-discharge-relief housing 91, the discharge valve member 94 is disposed adjacent to a bottom wall of the valve body 92. A discharge valve spring holder 945 holds a discharge valve spring 943. The discharge valve spring 943 biases the discharge valve member 94 toward the valve seat 93.

The relief valve member 96 is arranged in the fuel-discharge-relief housing 91. The relief valve member 96 is biased toward the relief passage 97 by a relief valve spring 963.

An operation of the high-pressure pump 1 will be described hereinafter.

(I) Suction Stroke

When the plunger 51 is moved down from the top dead center to the bottom dead center by rotation of the cam shaft, the volumetric capacity of the pressurization chamber 14 is increased and the fuel pressure in the pressurization chamber 14 is decreased. The discharge passage 95 is closed by the discharge valve member 94. At this time, since the coil 87 has not been energized, the needle 86 is moved toward the suction valve member 74 by the biasing force of the second spring 85. As a result, the needle 86 pushes the suction valve member 74 so that the suction valve portion 71 is opened. Thus, the fuel is suctioned into the pressurization chamber 14 from the suction chamber 711 through the first communication passage 141.

(II) Metering Stroke

When the plunger 51 is moved up from the bottom dead center to the top dead center by rotation of the cam shaft, the volumetric capacity of the pressurization chamber 14 is reduced. The energization of the coil 87 is stopped until a predetermined time. The suction valve member 74 is in the open state. Thus, a part of the fuel suctioned into the pressurization chamber 14 in the suction stroke 121 is returned to a low-pressure portion. When the energization of the coil 87 is started at the predetermined time in the process of the plunger 51 ascending, a magnetic attractive force is generated between the fixed core 83 and the movable core 84. When this magnetic attraction force becomes greater than the biasing force of the first and second springs 76, 85, the movable core 84 and the needle 86 move toward the fixed core 83. Consequently, the needle 86 relieves pressing force against the suction valve member 74. As a result, the suction valve member 74 is seated on the valve seat 731 formed in the seat body 73, so that the suction valve portion 71 is closed.

(III) Pressurization Stroke

After the suction valve portion 71 is closed, the fuel pressure in the pressurization chamber 14 is increased with ascent of the plunger 51. When the fuel pressure force exerted on the discharge valve member 94 becomes larger than the following resultant force, the discharge valve member 94 is opened. The resultant force is a resultant of the pressure force of fuel in the fuel discharge port 99 and the biasing force of the discharge valve spring 943. Thereby, high-pressure fuel pressurized in the pressurization chamber 14 is discharged from the fuel outlet 99 through the second communication passage 142. As mentioned above, the high-pressure pump 1 repeats the suction stroke, the metering stroke, and the pressurization stroke. The suctioned fuel is pressurized and discharged into the fuel accumulator through the fuel discharge port 99.

According to the present embodiment, the housing of the high-pressure pump 1 is comprised of the lower housing 11, the upper housing 15 and the cover 31, which are formed independently. Thereby, the shapes of the above can be simplified. The configuration of the housing of the high-pressure pump 1 can be simplified and its weight can be reduced.

Moreover, although the cylinder 13 and the plunger 51 receive the fuel pressure during the pressurization stroke, the upper housing 15 and the cover 31 do not receive fuel pressure directly from the pressurization chamber 14. Therefore, the upper housing 15 and the cover 31 can be made thin. The cover 31 can be easily shaped into a cup-shape.

The cylinder 13 is held by the cylinder-holding-portion 111 of the lower housing 11. The lower housing 11 is configured to have a high rigidity.

The cylinder-holding-portion 111 and the cylindrical engaging portion 113 are made by forging or pressing. Then, they are grinded in order to be smoothly engaged with the engine. The manufacturing cost of the lower housing can be reduced.

In the present embodiment, two walls of the octagonal portion 322 in which the first and the second through-holes 325, 326 are respectively formed are symmetrically arranged with respect to a shaft "O" of the plunger 51. The upper housing 15 is made from inexpensive material.

The hardness of the cylinder 13 is enhanced by heat treatment, such as quenching, in order to suppress seizure and wear due to sliding of the plunger 51. Generally, when the hardness of material is enhances, a rust-resistance is deteriorated. In the present embodiment, the cover 31 and the lower housing 11 form the outlined of the high-pressure pump 1. The cover 31 and the lower housing 11 are made from stainless steel which has high rust-resistance. As the result, the high-pressure pump 1 has high rust-resistance.

Moreover, according to the first embodiment, the suction valve body 72 is connected to the upper housing 15 through the first through-hole 325. Moreover, the fuel-discharge-relief housing 91 is connected to the upper housing 15 through the second through-hole 326. Thereby, the cover 31, the upper housing 15, the suction valve body 72 and the fuel-discharge-relief housing 91 can be easily connected to each other.

Furthermore, since the cover 31 and the upper housing 15 are made thin, the capacity of the fuel gallery 32 can be made large. Thus, when the fuel is suctioned into the pressurization chamber 14, the fuel pressure in the fuel gallery 32 is hardly decreased. Thus, a suction efficiency of the high-pressure pump 1 is improved. Also, the fuel pressure pulsation in the fuel gallery 32 is restricted by the pulsation damper 33.

The first through-hole 325 and the second through-hole 326 are formed in walls of the cover 31 which confront each other. Thus, the cover 31, the suction valve body 72 and the fuel-discharge-relief housing 91 are easily connected to each other.

Moreover, the octagonal portion 322 has eight walls. The first through-hole 325, the second through-hole 326 and the third through-hole 327 are respectively formed in different walls. Thus, the fuel inlet 35 and the cover 31 are easily connected to each other.

Second Embodiment

Figure 11:
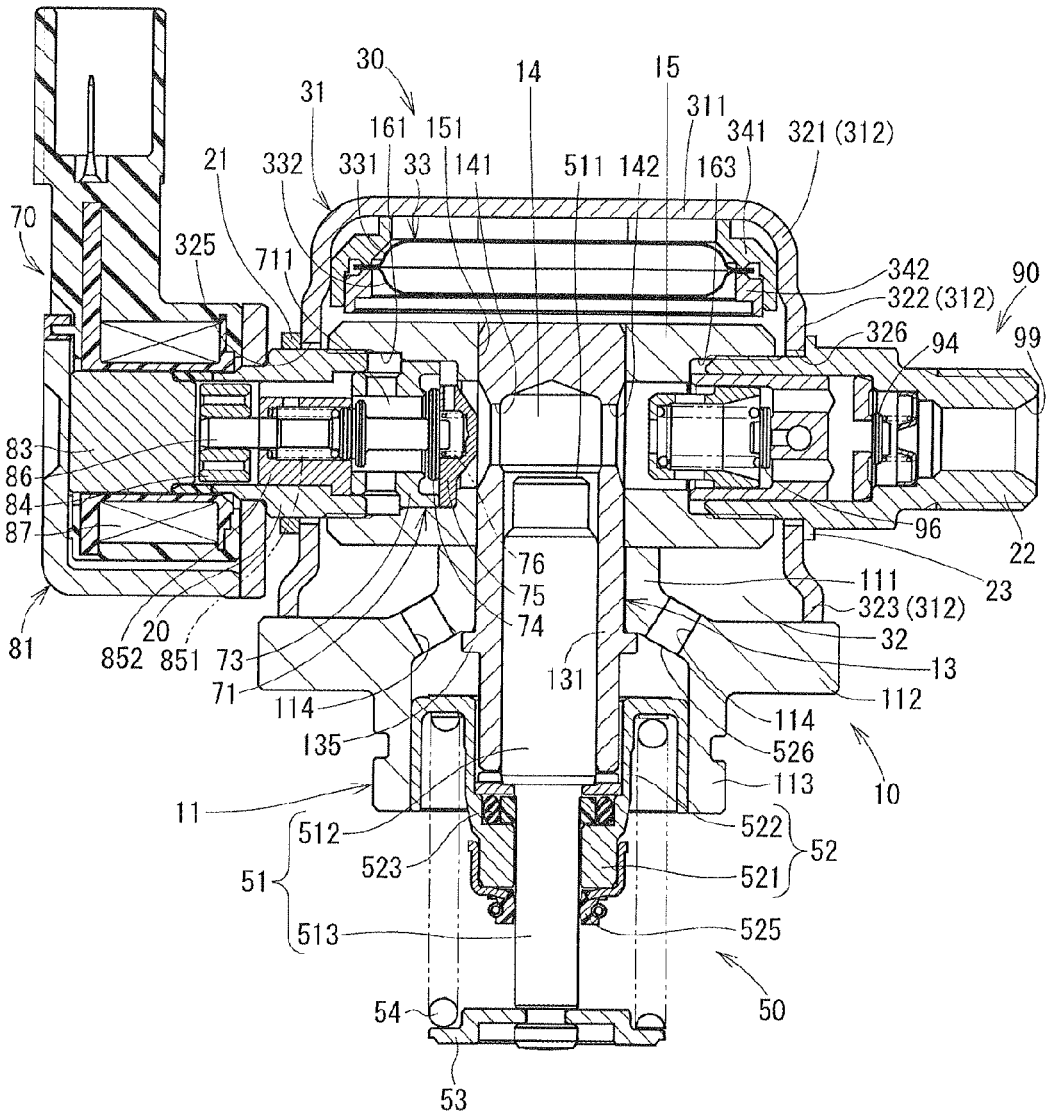
FIG. 11 is a cross-sectional view showing a high-pressure pump according to a second embodiment.
Figure 12:
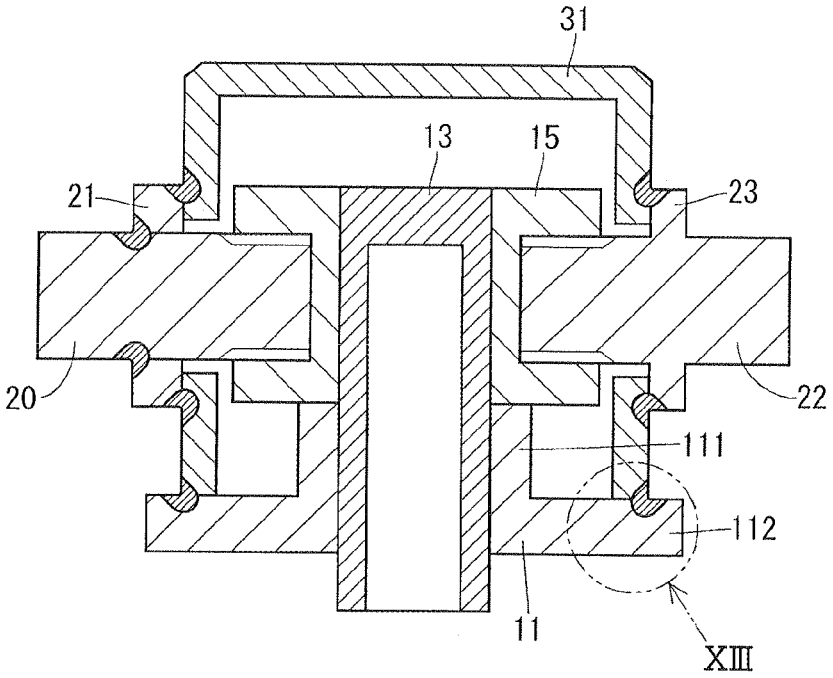
FIG. 12 is a schematic cross sectional view of a high-pressure pump shown in FIG. 11.
Figure 13:
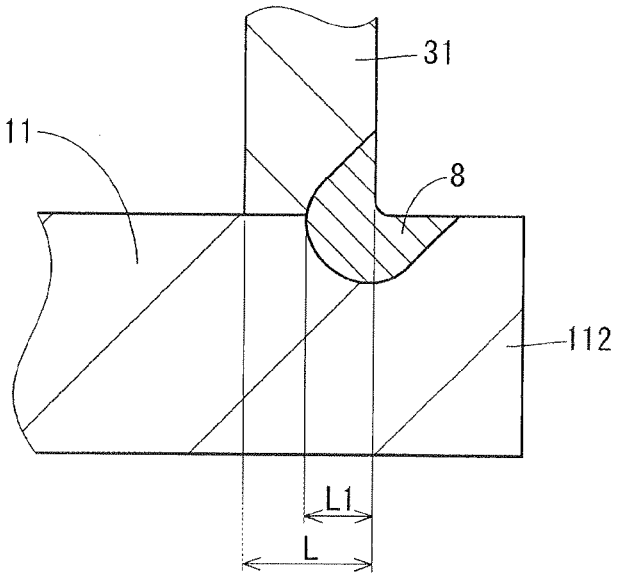
FIG. 13 is an enlarged view showing a welding portion between the cover and the lower housing, which is denoted by an arrow XIII in FIG. 11.

FIGS. 11 to 13 illustrate a high-pressure pump 1 according to a second embodiment of the invention. In the following embodiments, the substantially same parts and the components as those in the first embodiment are indicated with the same reference numeral and the same description will not be reiterated.

As shown in FIGS. 11 and 12, an annular clearance is formed between the first through-hole 325 of the cover 31 and the suction valve body 20. Also, another annular clearance is formed between the second through-hole 326 of the cover 31 and the fuel-discharge-relief housing 22. The suction valve body 20 has an annular first protrusion 21. The first protrusion 21 is welded to the suction valve body 20 and the cover 31 in such a manner as to close the first through-hole 325.

The fuel-discharge-relief housing 22 has an annular second protrusion 23. The second protrusion 23 is welded to the cover 31 in such a manner as to close the second through-hole 326. A lower opening end of the cover 31 is welded to the flange portion 112 of the lower housing 11. FIG. 13 shows a connecting portion between the cover 31 and the flange portion 112, which are connected by welding. A penetration bead 8 has a penetration depth "L1" from outer surface of the cover 31. This depth "L1" is smaller than a thickness "L" of the cover 31. Such a welding is applied to a welding portion between the cover 31 and the suction valve body 20 and a welding portion between the cover 31 and the fuel-outlet-relief-housing 22.

Referring to FIG. 11, an assembling method of the high-pressure pump according to the second embodiment will be described.

(I) First Press-Insert Step

In a first press-insert step, the cylinder 13 is press-inserted into the lower housing 11. The annular protrusion 135 is brought into contact with a lower end surface of the cylinder-holding portion 111 of the lower housing 11.

(II) Second Press-Insert Step

In a second press-insert step, the upper housing 15 is press-inserted into the cylinder 13. At this time, a circumferential position of the first suction passage 161 agrees with a circumferential position of the first communication passage 141. A circumferential position of the second suction passage 162 agrees with a circumferential position of the second communication passage 142. The upper housing 15 is brought into contact with an upper end surface of the cylinder-holding portion 111 of the lower housing 11.

(III) Valve Arrange Step

In a valve arrange step, the cover 31 is provided on the upper housing 15. The fuel-discharge-relief housing 22 is inserted into the second through-hole 326 to be threaded to the upper housing 15. Then, the suction valve body 20 is inserted into the first through-hole 325 to be threaded into the upper housing 15. At this moment, the other parts of the suction valve portion 71 are connected to the upper housing 15.

(IV) Cover Fixing Step

In a cover fixing step, while the opening end of the cover 31 is in contact with the flange portion 112 of the lower housing 11, the annular portion 21 is press-inserted into the valve body 20. At this time, an outer wall surface of the cover 31 is brought into contact with the annular portion 21 and the annular portion 23. Thereby, the cover 31 is fixed relative to the lower housing 11 and each valve body.

(V) Welding Step

In a welding, the annular protrusion 23 is welded to the cover 31, the suction valve body 20 is welded to the annular protrusion 21, the annular protrusion 21 is welded to the cover 31, and the cover 31 is welded to the flange portion 112. These welding are performed by laser welding. As shown in FIG. 13, a penetration bead 8 has a penetration depth "L1" from outer surface of the cover 31. This depth "L1" is smaller than a thickness "L" of the cover 31.

As described above, according to the second embodiment, the cover 31 is fixed relative to the suction valve body 20 and the fuel-discharge-relief housing 22 and the lower housing 11 is in contact with the cover 31. And then, the cover 31, the suction valve body 20, the fuel-discharge-relief housing and the lower housing 11 are welded together. Thus, when welding each part, it is restricted that each part is deformed.

First Modification of Second Embodiment

Figure 14:
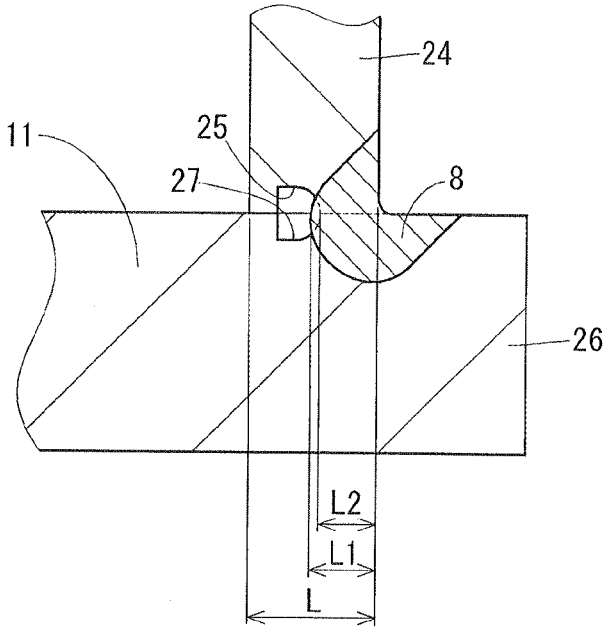
FIG. 14 is an enlarged view showing a welding portion between the cover and the lower housing according to a first modification of the second embodiment.

As shown in FIG. 14, annular clearance grooves 25, 27 are formed on a contacting surface between the cover 24 and the flange portion 26. A distance between an outer surface of the cover 24 and the outer end of the clearance grooves 25, 27 is set as "L2". A penetration bead 8 has a penetration depth "L1" from outer surface of the cover 24. This depth "L1" is smaller than a thickness "L" of the cover 24 and is greater than the distance "L2". A deformation of each part is restricted and a welding strength can be enhanced.

Second Modification of Second Embodiment

Figure 15:
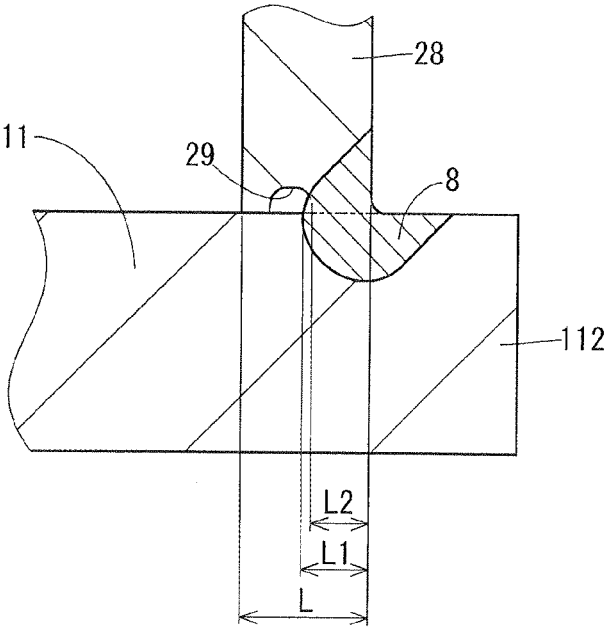
FIG. 15 is an enlarged view showing a welding portion between the cover and the lower housing according to a second modification of the second embodiment.

As shown in FIG. 15, an annular clearance groove 29 is formed on a contacting end surface of a cover 28. A distance between an outer surface of the cover 28 and the outer end of the clearance groove 29 is set as "L2". A penetration bead 8 has a penetration depth "L1" from outer surface of the cover 28. This depth "L1" is smaller than a thickness "L" of the cover 28 and is greater than the distance "L2". A deformation of each part is restricted and a welding strength can be enhanced.

Third Embodiment

Figure 16:
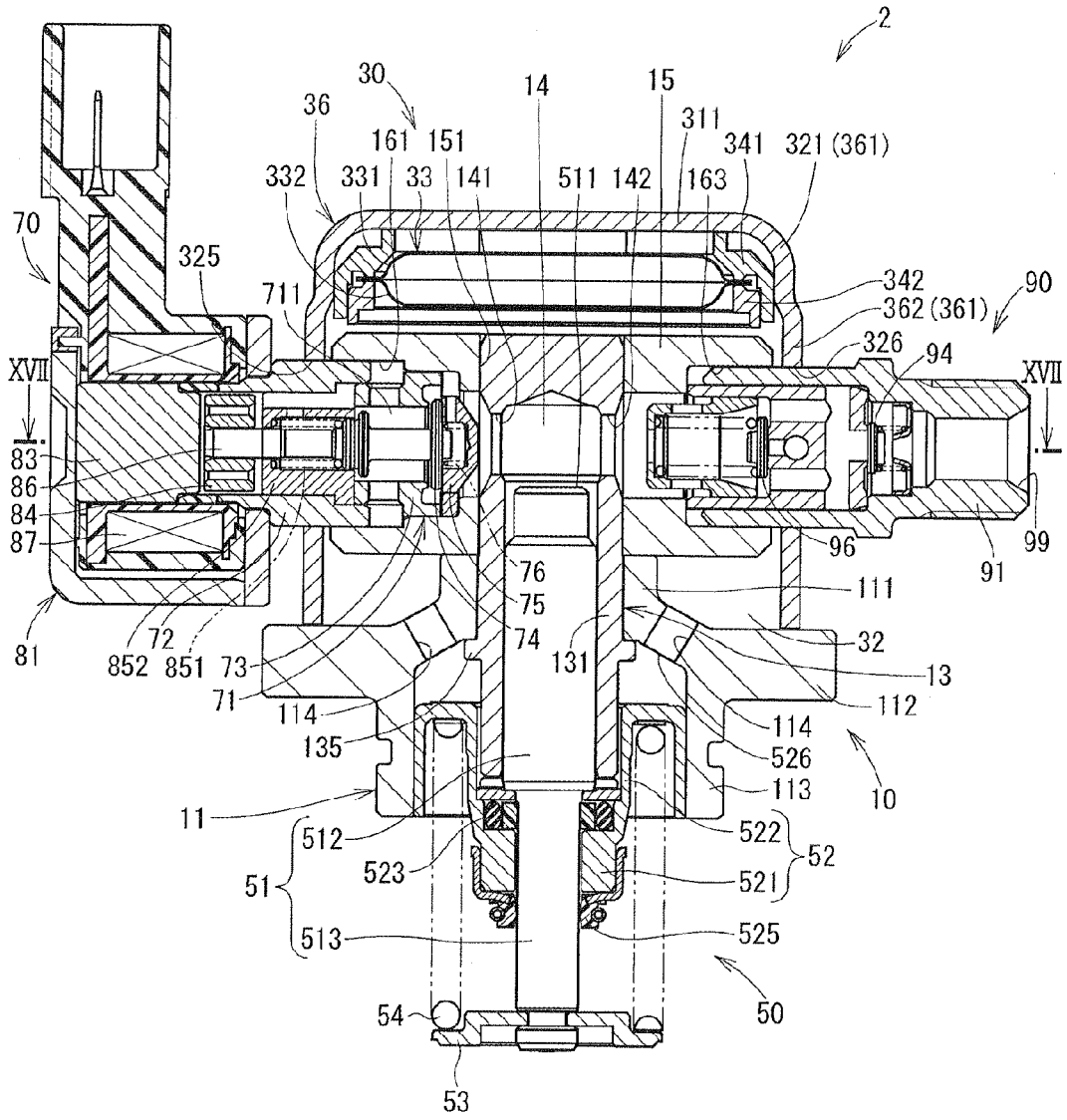
FIG. 16 is a cross-sectional view showing a high-pressure pump according to a third embodiment.
Figure 17:
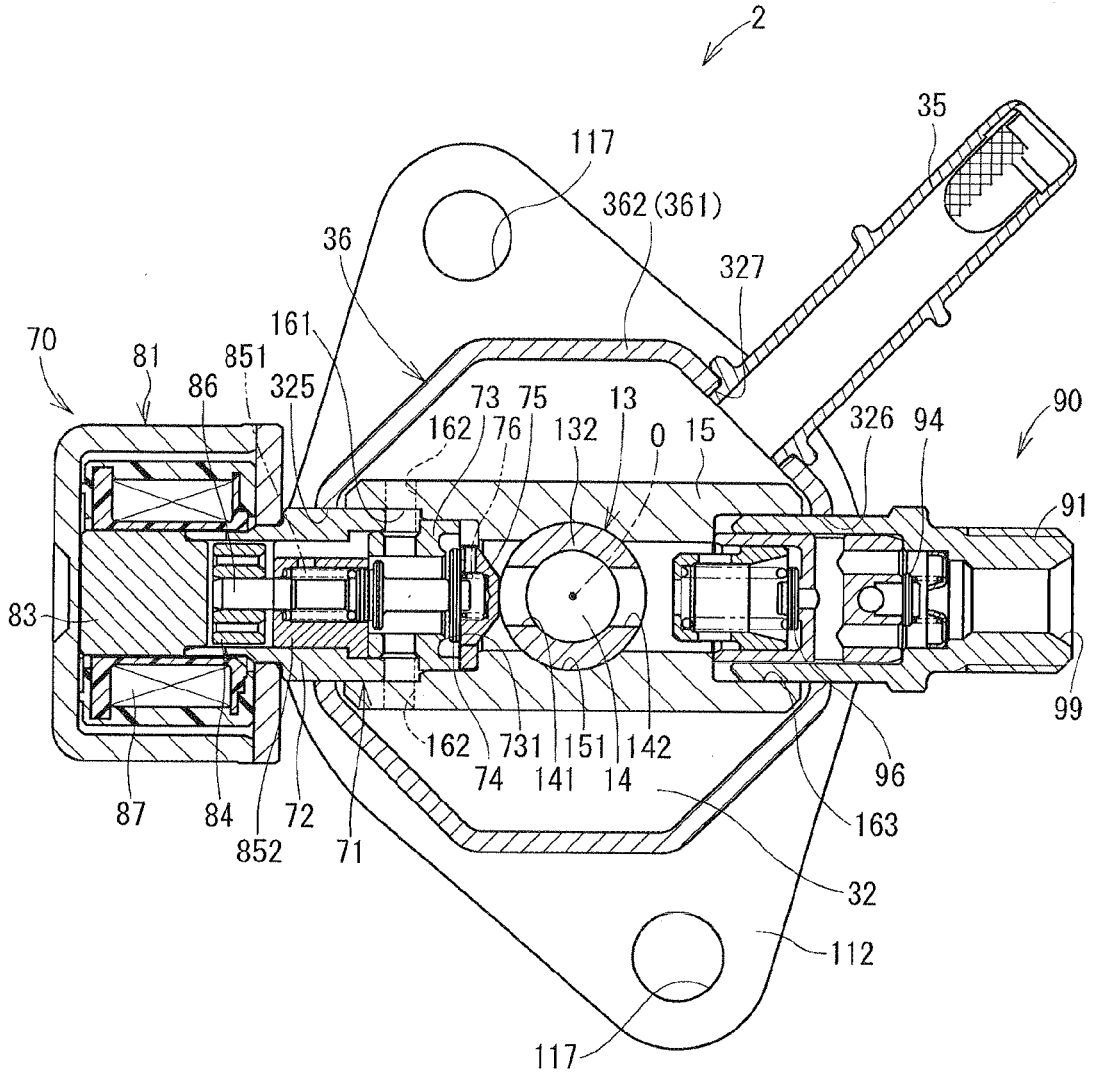
FIG. 17 is a cross-sectional view taken along a line XVII-XVII in FIG. 16.

Following third to eighth embodiments are partly different from the first embodiment in the shape of the cover and the upper housing. FIGS. 16 and 17 illustrate a high-pressure pump according to a third embodiment. The cover 36 of the high-pressure pump 2 has a flat portion 311 and a cylindrical portion 361. The cylindrical portion 361 has a first cylindrical portion 321 and an octagonal portion 362.

The octagonal portion 322 has an octagonal cross section. The first through-hole 325 and the second through-hole 326 are symmetrically arranged with respect to the center axis "O" of the plunger 51. Further, as shown in FIG. 17, the octagonal portion 322 has a third through-hole 327 circumferentially adjacent to the second through-hole 326. The cover 36 is welded to the flange portion 112. The cover 31 is made of stainless steel.

Fourth Embodiment

Figure 18:
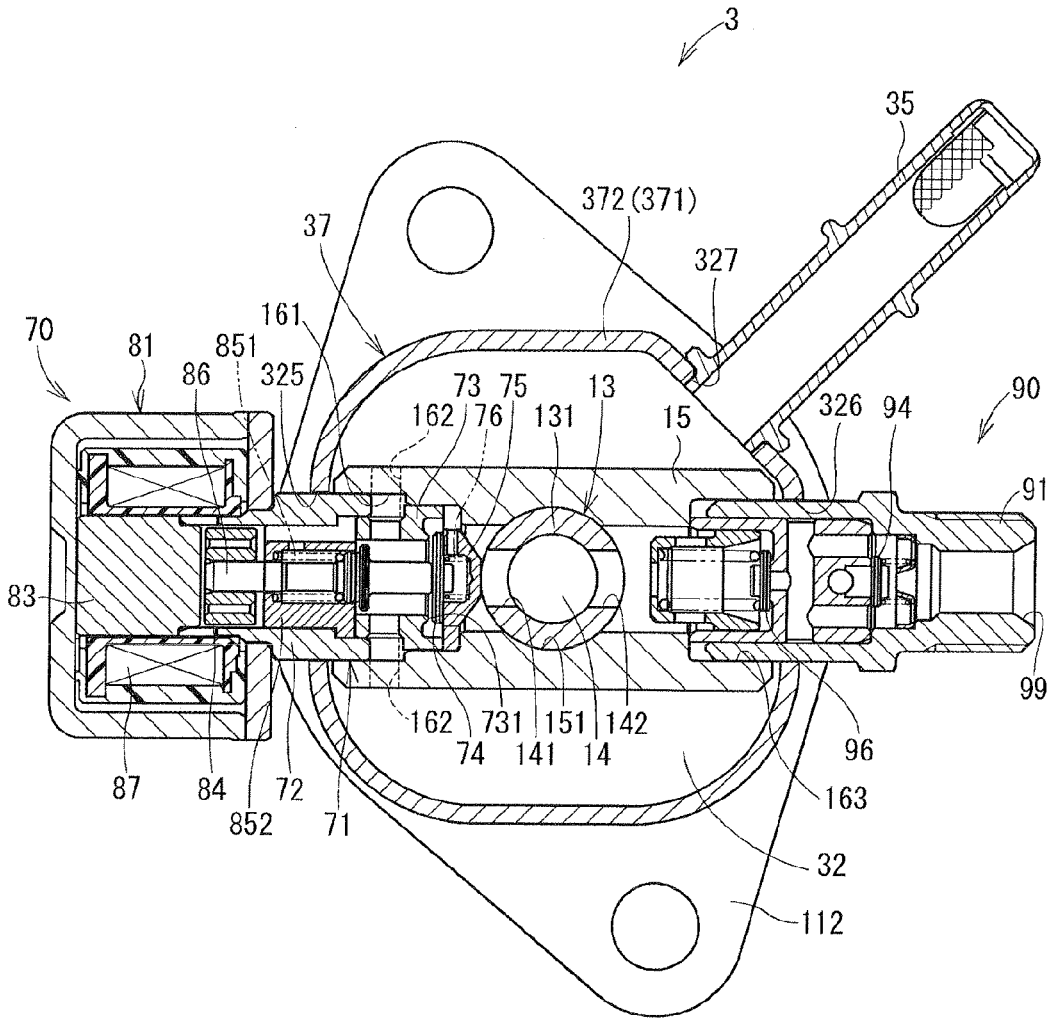
FIG. 18 is a cross-sectional view showing a high-pressure pump according to a fourth embodiment.

Referring to FIG. 18, a high-pressure pump 3 according to a fourth embodiment will be described hereinafter. The cover 37 of the high-pressure pump 3 has a cylindrical portion 371. The cylindrical portion 371 has a first cylindrical portion 321 and a square portion 372. The square portion 372 has a square cross section. The first through-hole 325 and the second through-hole 326 are symmetrically arranged with respect to the center axis "O" of the plunger 51.

As shown in FIG. 18, a third through-hole 327 is formed in a chambered portion of the square portion 372. The cover 37 is welded to the flange portion 112.

The cover 37 is made of stainless steel.

Fifth Embodiment

Figure 19:
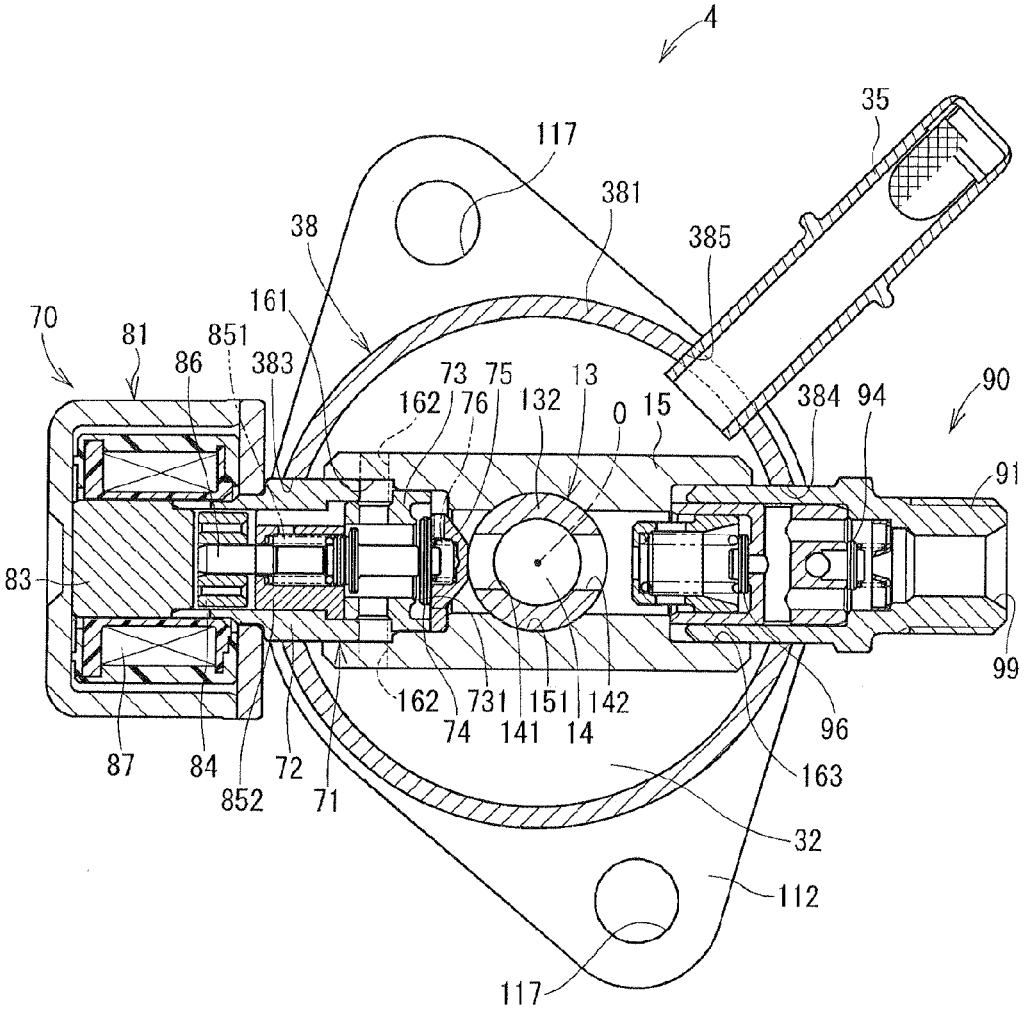
FIG. 19 is a cross-sectional view showing a high-pressure pump according to a fifth embodiment.

Referring to FIG. 19, a high-pressure pump 4 according to a fifth embodiment will be described hereinafter. The cover 38 of the high-pressure pump 4 has a cylindrical portion 381. The cylindrical portion 381 forms outer wall of the cover 38.

The cylindrical portion 381 has a circular cross section. A first through-hole 382 and a second through-hole 383 are symmetrically arranged with respect to an axis of the plunger 51. Further, as shown in FIG. 19, a third through-hole 384 is formed circumferentially adjacent to the second through-hole 383. The cover 38 is welded to the flange portion 112. The cover 38 is made of stainless steel.

The cover 38 can be easily shaped to a desired shape without increasing a manufacturing cost.

Sixth Embodiment

Figure 20:
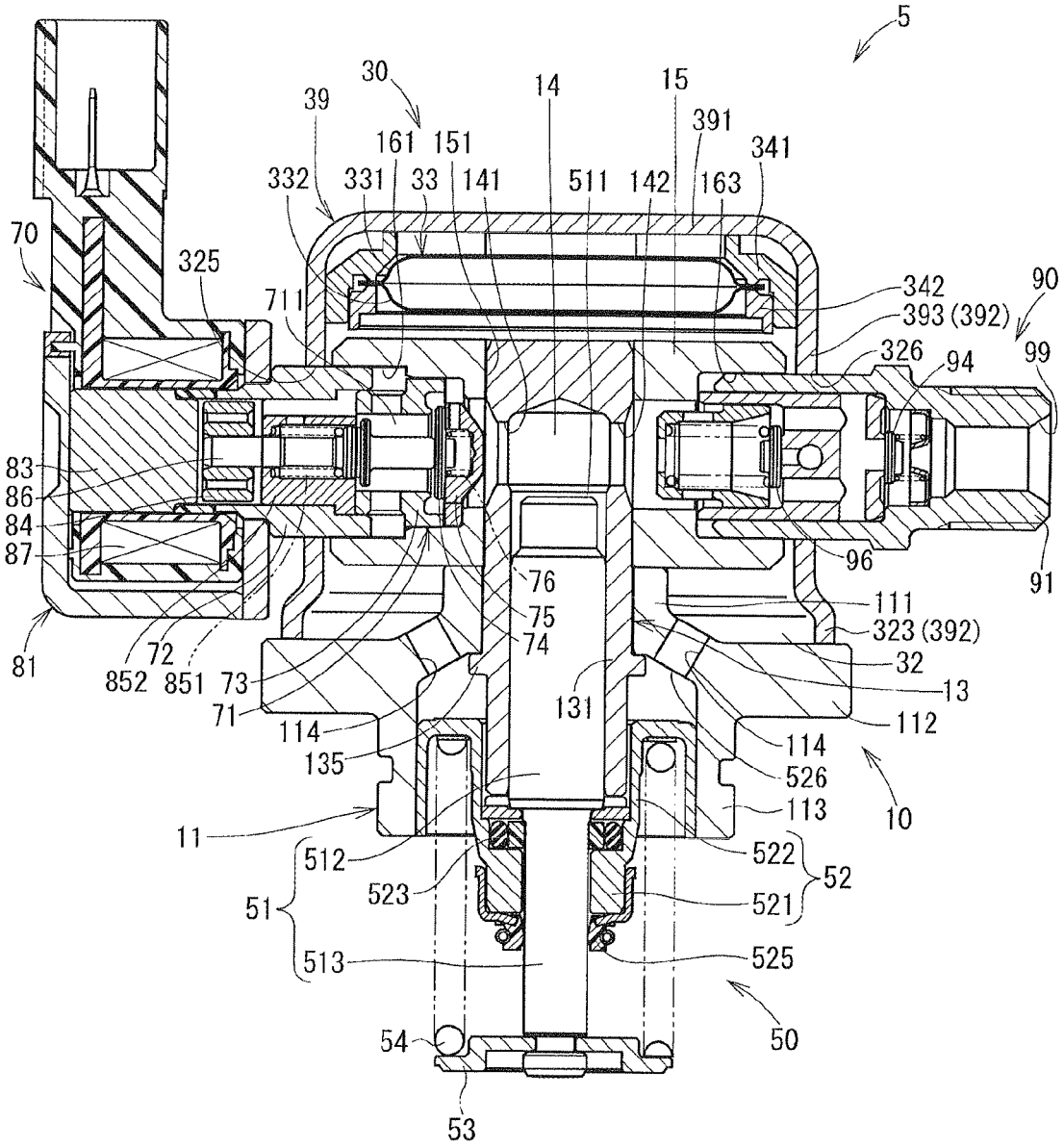
FIG. 20 is a cross-sectional view showing a high-pressure pump according to a sixth embodiment.

Referring to FIG. 20, a high-pressure pump 5 according to a sixth embodiment will be described hereinafter. The cover 39 of the high-pressure pump 5 has a flat portion 391 and a cylindrical portion 392. The cylindrical portion 392 forms outer wall of the cover 39. The cylindrical portion 392 is comprised of an octagonal portion 393 and a second cylindrical portion 323.

The octagonal portion 393 has an octagonal cross section. The first through-hole 325 and the second through-hole 326 are symmetrically arranged with respect to the center axis "O" of the plunger 51. A third through-hole is formed in the octagonal portion 393 to receive the fuel inlet. The cover 39 is welded to the flange portion 112.

The cover 39 is made of stainless steel. The cover 39 can be easily shaped to a desired shape without increasing a manufacturing cost.

Seventh Embodiment

Figure 21:
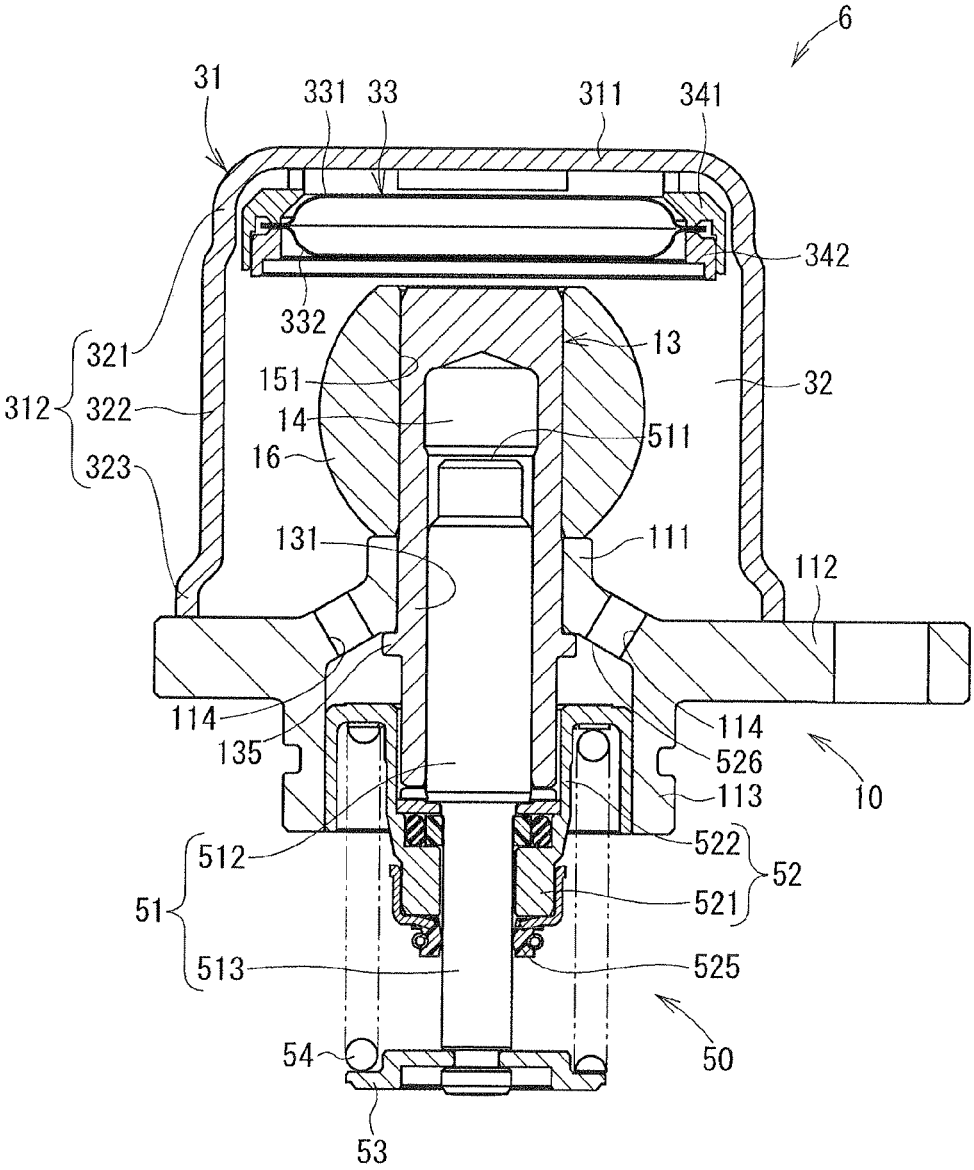
FIG. 21 is a cross-sectional view showing a high-pressure pump according to a seventh embodiment.

Referring to FIG. 21, a high-pressure pump 6 according to a seventh embodiment will be described hereinafter. As illustrated in FIG. 21, the upper housing 16 is substantially in a shape of a barrel. The upper housing 16 has the press-insert hole 151, the first suction passage 161, the second suction passage 162 and the first discharge passage 163. The upper housing 16 does not receive any fuel pressure directly from the pressurization chamber 14, whereby the upper housing 16 can be simply configured.

Eighth Embodiment

Figure 22:
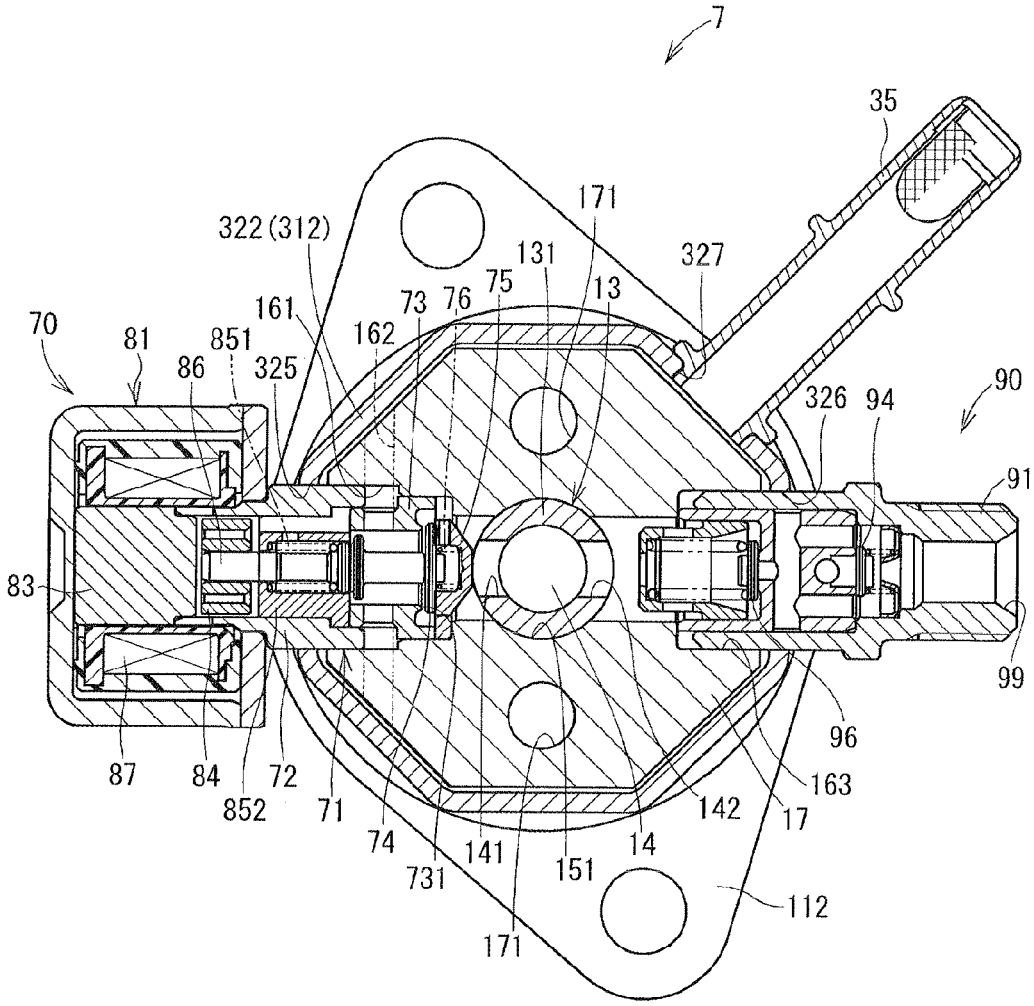
FIG. 22 is a cross-sectional view showing a high-pressure pump according to an eighth embodiment.

Referring to FIG. 22, a high-pressure pump 7 according to an eighth embodiment will be described hereinafter. As illustrated in FIG. 22, the upper housing 17 of the high-pressure pump 7 is substantially an octagonal column. The outer surface of the upper housing 17 is configured to correspond to the inner wall surface of the octagonal portion 322. The upper housing 17 has a fuel passage 171 extending its axial direction. This fuel passage 171 communicates fuel galleries which are respectively defined at upper portion and lower portion of the upper housing 17.

The upper housing 17 does not receive fuel pressure directly from the pressurization chamber 14, whereby the upper housing 17 can be simply configured. According to the eighth embodiment, the positions of the fuel suction port 70 and the fuel-discharge-relief portion 90 can be easily changed.

Ninth Embodiment

Figure 23:
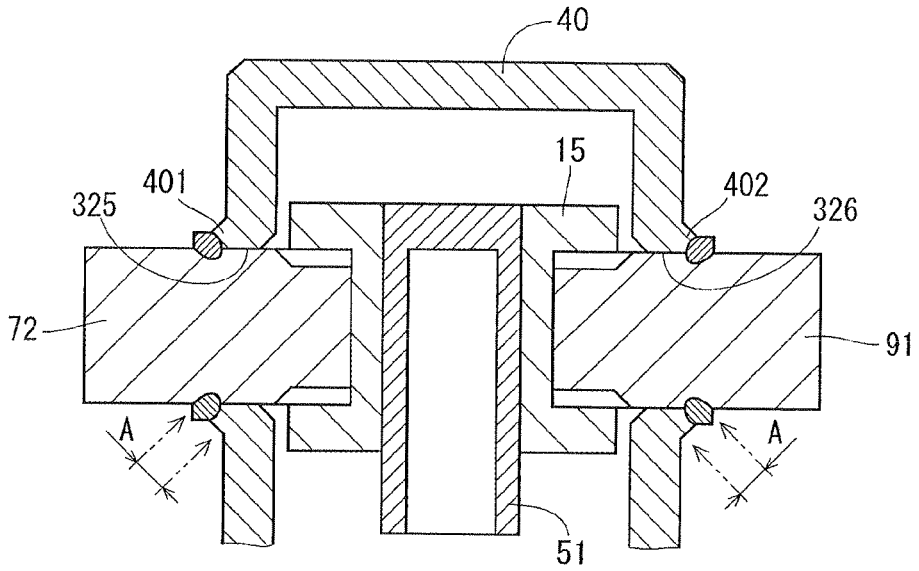
FIG. 23 is a schematic cross sectional view of a cover, an upper housing, a plunger, a suction valve body and a discharge valve body according to a ninth embodiment.

Following ninth to thirteenth embodiments are partly different from the first embodiment in shapes of the cover, the suction valve body and the fuel-discharge-relief housing. Referring to FIG. 23, a cover 40 according to the ninth embodiment will be described hereinafter. The cover 40 has a first cylindrical protrusion 401 and a second cylindrical protrusion 402. These first and second cylindrical protrusions 401, 402 are formed by burring.

The suction valve body 72 is welded to an inner surface of the first cylindrical protrusion 401. The fuel-discharge-relief housing 91 is welded to an inner surface of the second cylindrical protrusion 402.

In a case of laser welding, the laser is radiated to within an area denoted by "A" in FIG. 23.

Tenth Embodiment

Figure 24:
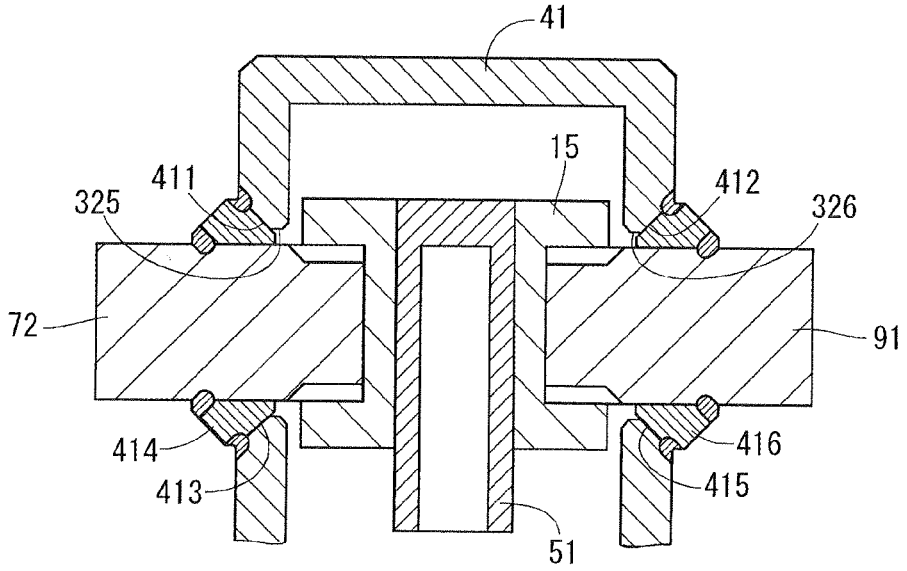
FIG. 24 is a schematic cross sectional view of a cover, an upper housing, a plunger, a suction valve body and a discharge valve body according to a tenth embodiment.

Referring to FIG. 24, a cover 41 according to a tenth embodiment will be described hereinafter. The cover 41 has a first tapered inner surface 411 and a second tapered inner surface 412 around the first through-hole 325 and the second through-hole 326. A first taper ring 414 having a first tapered outer surface 413 is provided on the first tapered inner surface 411. This first taper ring 414 is welded to both the cover 41 and the suction valve body 72.

A second taper ring 416 having a second tapered outer surface 415 is provided on the second tapered inner surface 412. This second taper ring 416 is welded to both the cover 41 and the fuel-discharge-relief housing 91.

Even if a position of the first through-hole 325 deviates from the suction valve body 72, the first taper ring 414 is biased to the first tapered inner surface 411, so that the gap between the cover 41 and the suction valve body 72 is reduced. Even if a position of the second through-hole 326 deviates from the fuel-discharge-relief housing 91, the second taper ring 416 is biased to the second tapered inner surface 412, so that the gap between the cover 41 and the fuel-discharge-relief housing 91 is reduced. Thus, the cover 31, the suction valve body 72 and the fuel-discharge-relief housing 91 are easily welded to each other.

Eleventh Embodiment

Figure 25:
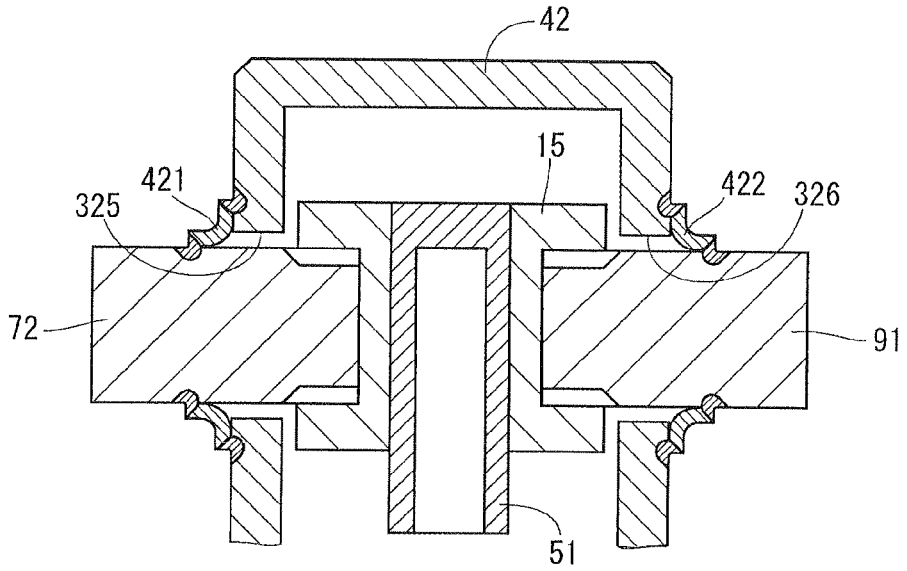
FIG. 25 is a schematic cross sectional view of a cover, an upper housing, a plunger, a suction valve body and a discharge valve body according to an eleventh embodiment.

Referring to FIG. 25, a cover 42 according to an eleventh embodiment will be described hereinafter. The cover 42 has a first through-hole 325 and a second through-hole 326. A first annular auxiliary member 421 is disposed between the first through-hole 325 and the suction valve body 72. An outer periphery of the first auxiliary member 421 is welded to the cover 42 and an inner periphery of the first auxiliary member 421 is welded to the suction valve body 72.

A second annular auxiliary member 422 is disposed between the second through-hole 326 and the fuel-discharge-relief housing 91. An outer periphery of the second auxiliary member 422 is welded to the cover 42 and an inner periphery of the second auxiliary member 422 is welded to the fuel-discharge-relief housing 91.

Even if a gap clearance between the first through-hole 325 and the suction valve body 72 is large, these two members can be connected through the first auxiliary member 421. Even if a gap clearance between the second through-hole 326 and the fuel-discharge-relief housing 91 is large, these two members can be connected through the second auxiliary member 422. Thus, accuracies of finishing of the inner surfaces of the first and second through-holes 325, 326 and the outer surfaces of the suction valve body 72 and fuel-discharge-relief housing 91 are not always required to be high. Thus, manufacturing cost of the cover 42, the suction valve body 72 and the fuel-discharge-relief housing 91 can be reduced.

Twelfth Embodiment

Figure 26:
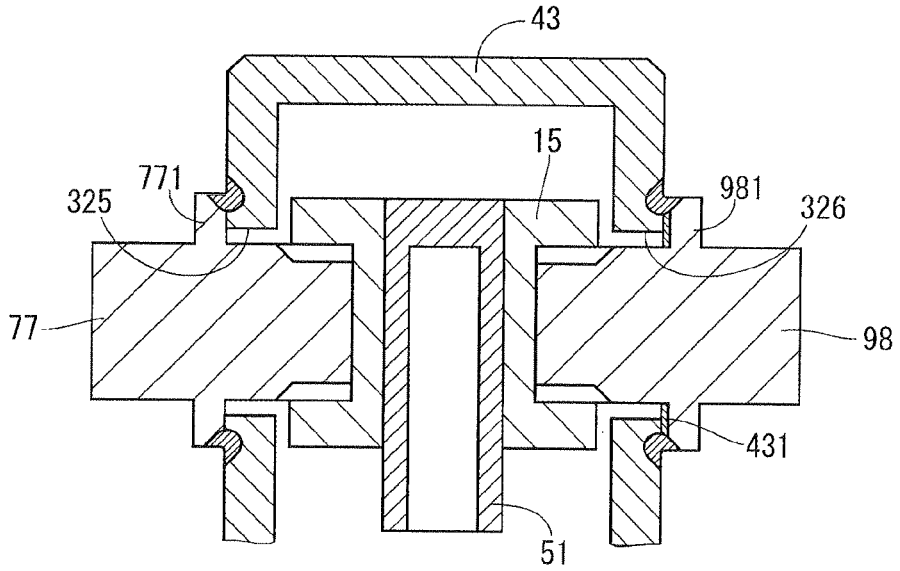
FIG. 26 is a schematic cross sectional view of a cover, an upper housing, a plunger, a suction valve body and a discharge valve body according to a twelfth embodiment.

Referring to FIG. 26, a cover 43 according to a twelfth embodiment will be described hereinafter. The cover 43 has a first through-hole 325 and a second through-hole 326. A suction valve body 77 has an annular protrusion 771. The annular protrusion 771 is welded to the cover 43.

The fuel-discharge-relief housing 98 has an annular protrusion 981. A gap clearance between the annular protrusion 981 and the cover 43 is filled with a shim 431. The annular protrusion 981 is welded to the cover 43.

Thirteen Embodiment

Figure 27:
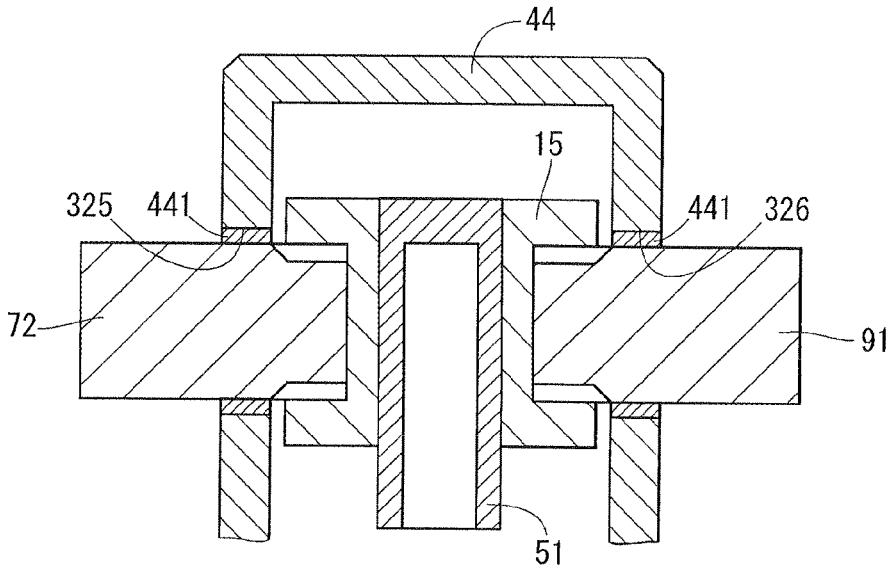
FIG. 27 is a schematic cross sectional view of a cover, an upper housing, a plunger, a suction valve body and a discharge valve body according to a thirteenth embodiment.

Referring to FIG. 27, a cover 44 according to a thirteenth embodiment will be described hereinafter. The cover 44 is connected to the suction valve body 72 and the fuel-discharge-relief housing 91 by laser brazing. A brazing filler metal 441 is welded by laser.

The cover 44, the suction valve body 72 and the fuel-discharge-relief housing 91 Thus, the cover 31, the suction valve body 72 and the fuel-discharge-relief housing 91 are easily connected with low cost.

Other Embodiment

The cover may not have a cylindrical portion. Any polygonal other than octagonal or square can be applied to the cover.

The cylinder and the cylinder-holding portion can be connected by shrinkage fitting or expansion fitting. Also, the cylinder and the upper housing can be connected by shrinkage fitting or expansion fitting.

A cross section of the first through-hole and the second through-hole can be oval or ellipse. An annular member may be fixed on the fuel-discharge-relief housing, and an annular protrusion may be formed on the suction valve body. In the second embodiment, the second protrusion may be formed by expanding a part of the fuel-discharge-relief housing. The clearance groove may be formed only on a flange portion of the lower housing.

The suction passage and the discharge passage may not be always arranged symmetrically. The suction valve and the discharge valve may not be always arranged symmetrically. The first through-hole and the second through-hole may not be always arranged symmetrically with respect to an axis of the plunger. The pulsation damper may be disposed at any places other than a bottom of the cover.

The present invention is not limited to the embodiments mentioned above, and can be applied to various embodiments.

What is claimed is:

1. A high-pressure pump comprising:

a plunger performing a reciprocating movement;

a cylinder receiving the plunger to define a pressurization chamber therein;

an upper housing having a suction passage through which a fuel is suctioned into the pressurization chamber, the upper housing having a discharge passage through which the fuel pressurized in the pressurization chamber is discharged;

a cup-shaped cover formed independently from the upper housing, the cup-shaped cover accommodating the upper housing and the cup-shaped cover comprising the cover comprising a first cylindrical portion, a polygonal portion and a second cylindrical portion; and a lower housing formed independently from the upper housing, the lower housing defining a fuel gallery with the cup-shaped cover; wherein the first cylindrical portion and the second cylindrical portion each have a circular cross section, the polygonal portion has a polygonal cross section comprising a plurality of flat surfaces, the polygonal portion of the cup-shaped cover has a first through-hole confronting the suction passage, a second through-hole confronting the discharge passage, and a third through-hole through which the fuel flows into the fuel gallery;

the cup-shaped cover has an opening end that is joined to the lower housing by welding in a fluid-tight manner, so that the fuel gallery is defined by the cup-shaped cover and the lower housing, the fuel gallery communicates with the suction passage, so that the fuel in the fuel gallery flows into pressurization chamber flows into the pressurization chamber passage, the first through-hole, the second through-hole and the third through-hole are formed on the flat surfaces of the polygonal portion respectively, the polygonal portion is positioned between the first cylindrical portion and the second cylindrical portion in an axial direction of the cup-shaped cover, and the first cylindrical portion and the second cylindrical portion are continuously connected to the polygonal portion through curved walls.

2. A high-pressure pump according to claim 1, wherein the cylinder has an inner wall surface on which the plunger slides, the inner wall surface defines the pressurization chamber in cooperation with a top surface of the plunger, the lower housing has a cylinder holding portion which holds the cylinder, and the cylinder has an annular protrusion which is in contact with the cylinder holding portion, so that an axial position of the cylinder relative to the cylinder holding portion is fixed.

3. A high-pressure pump according to claim 1, wherein the cup shaped cover is provided with a fuel inlet that is fluidly connected to the third through-hole.

4. A high-pressure pump according to claim 1, wherein the fuel gallery is defined between an outer wall surface the upper housing of the high pressure pump and an inner wall surface of the cup shaped cover.

5. A high-pressure pump according to claim 1, wherein the cylinder and the upper housing are formed independently from each other.

* * * * *